US010153584B2

(12) United States Patent
Iwabe et al.

(10) Patent No.: US 10,153,584 B2
(45) Date of Patent: Dec. 11, 2018

(54) CONNECTOR WITH ELECTROCONDUCTIVE MEMBER FEATURING RETRACTION MECHANISM

(71) Applicant: Yazaki Corporation, Tokyo (JP)

(72) Inventors: Masaaki Iwabe, Shizuoka (JP); Yuya Yamada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/907,132

(22) Filed: Feb. 27, 2018

(65) Prior Publication Data

US 2018/0269624 A1 Sep. 20, 2018

(30) Foreign Application Priority Data

Mar. 15, 2017 (JP) ..... 2017-049797

(51) Int. Cl.

| | |
|---|---|
| ***H01R 13/621*** | (2006.01) |
| ***H01R 13/631*** | (2006.01) |
| ***H01R 13/6581*** | (2011.01) |
| ***H01R 13/6593*** | (2011.01) |
| *H01B 1/02* | (2006.01) |
| *H01R 24/58* | (2011.01) |
| *H01R 103/00* | (2006.01) |

(52) U.S. Cl.

CPC ..... *H01R 13/6215* (2013.01); *H01R 13/631* (2013.01); *H01R 13/6581* (2013.01); *H01R 13/6593* (2013.01); *H01B 1/02* (2013.01); *H01R 24/58* (2013.01); *H01R 2103/00* (2013.01)

(58) Field of Classification Search

CPC ..... H01R 13/6215; H01R 13/631; H01R 13/6581; H01R 13/6593

USPC ..... 439/359

See application file for complete search history.

(56) References Cited

U.S. PATENT DOCUMENTS 2,955,273 A * 10/1960 Winkler ..... H01R 13/635 439/153

5,836,781 A * 11/1998 Hyzin ..... H01R 13/6276 439/348

(Continued)

FOREIGN PATENT DOCUMENTS

JP 6036653 B2 11/2016

*Primary Examiner* — Hae Moon Hyeon
*Assistant Examiner* — Peter G Leigh
(74) *Attorney, Agent, or Firm* — Kenealy Vaidya LLP

(57) ABSTRACT

A connector includes a housing, an electroconductive member, and a retraction mechanism. The housing includes: a fitting portion to be fit to a counterpart fitting portion of a casing of a device to which the connector is to be connected; and a fixture portion to be secured to a fixture-portion receiving portion of the casing. The fixture portion is brought into contact with the fixture-portion receiving portion during a progress of the fitting of the fitting portion. The electroconductive member includes: a first electrical-connection portion to be brought into contact with a counterpart electrical-connection portion and thereby electrically connected thereto during the progress of the fitting of the fitting portion, the counterpart electrical-connection portion being included in the counterpart fitting portion; and a second electrical-connection portion connected electrically to a terminal of an electric wire. The electroconductive member is accommodated in an interior of the housing.

12 Claims, 12 Drawing Sheets

(56) References Cited

U.S. PATENT DOCUMENTS

| | | | | |
|---|---|---|---|---|
| 8,662,910 | B2 * | 3/2014 | Ichio | H01R 13/5208 439/206 |
| 9,463,702 | B2 * | 10/2016 | Fukushima | H01R 13/506 |
| 9,472,882 | B2 * | 10/2016 | Kurita | B60L 11/1818 |
| 9,478,921 | B2 * | 10/2016 | Osawa | H01R 13/748 |
| 2009/0130916 | A1 * | 5/2009 | Ishizuka | H01R 13/64 439/701 |
| 2015/0064951 | A1 * | 3/2015 | Gencel | H01R 13/5219 439/271 |
| 2015/0111398 | A1 * | 4/2015 | Isenhour | H01R 13/6205 439/39 |
| 2015/0129305 | A1 | 5/2015 | Yoshida et al. | |
| 2015/0147905 | A1 * | 5/2015 | Matsuda | B60L 11/18 439/490 |
| 2015/0343914 | A1 * | 12/2015 | Osawa | B60L 11/1818 439/205 |
| 2016/0093979 | A1 * | 3/2016 | Sprenger | H01R 13/5213 439/136 |
| 2016/0248195 | A1 * | 8/2016 | Feldner | H01R 13/502 |
| 2017/0054248 | A1 * | 2/2017 | Moseke | H01R 13/5227 |
| 2018/0269624 | A1 * | 9/2018 | Iwabe | H01R 13/6215 |

* cited by examiner

CONNECTOR WITH ELECTROCONDUCTIVE MEMBER FEATURING RETRACTION MECHANISM

CROSS-REFERENCE TO RELATED APPLICATION(S)

The present application claims priority to and incorporates by reference the entire contents of Japanese Patent Application No. 2017-049797 filed in Japan on Mar. 15, 2017.

BACKGROUND OF THE INVENTION

1. Field of the Invention

The present invention relates to a connector.

2. Description of the Related Art

Conventionally, there has been known a connector including an electrical-connection portion that, during the progress of fitting the connector to another connector, makes contact with an electrical-connection portion of the other connector at the same time as respective fixture portions of the housings of these connectors make contact with each other. For example, Japanese Patent No. 6036653 discloses a connector configured so that connection thereof to another connector can be completed by both securing fixture portions of these connectors to each other with screws with these fixtures in contact with each other, and securing electrical-connection portions of these connectors to each other with screws with these electrical-connection portions in contact with each other.

In two connectors to be fit to each other, there are tolerance variations among individual parts, and assembly variations between the parts. In each of the connectors, the position of a fixture portion relative to an electrical-connection portion may be consequently shifted from a designed position. Particularly when both of the connectors are of this type, the electrical-connection portions of the respective connectors may receive excess loads upon completion of the connection therebetween with such positional shifts of the electrical-connection portions relative to the fixture portions caused along directions in which the connectors are fit to each other.

SUMMARY OF THE INVENTION

In view of the above inconvenience, the present invention is aimed at providing a connector capable of preventing a load from acting on an electrical-connection portion upon completion of connection thereof.

A connector according to one aspect of the present invention includes a housing including a fitting portion to be fit to a counterpart fitting portion of a casing of a device to which the connector is to be connected, and a fixture portion to be secured to a fixture-portion receiving portion of the casing, in which the fixture portion is brought into contact with the fixture-portion receiving portion during a progress of the fitting of the fitting portion; an electroconductive member including a first electrical-connection portion to be brought into contact with a counterpart electrical-connection portion and thereby electrically connected thereto during the progress of the fitting of the fitting portion, the counterpart electrical-connection portion being included in the counterpart fitting portion, and a second electrical-connection portion connected electrically to a terminal of an electric wire, and accommodated in an interior of the housing; and a retraction mechanism configured to, when the first electrical-connection portion makes contact with the counterpart electrical-connection portion before the fixture portion makes contact with the fixture-portion receiving portion, enable the electroconductive member and a terminal of the electric wire to be retracted, until the fixture portion makes contact with the fixture-portion receiving portion, with the first electrical-connection portion kept in contact with the counterpart electrical-connection portion.

According to another aspect of the present invention, it is preferable that the connector further includes a male screw member and a female screw member that are screw members together having a screwing axis set in parallel to directions in which the fitting portion is fit to and pulled out from the counterpart fitting portion, the male screw member and the female screw member being configured to fasten together an electrical-connection portion of a terminal fitting attached to a terminal of the electric wire and the second electrical-connection portion of the electroconductive member, wherein the retraction mechanism includes a protrusion that is a part of one of the male screw member and the female screw member that have been screwed together, the part protruding from the second electrical-connection portion and the electrical-connection portion, and a retraction guide portion formed in the housing and capable of guiding the protrusion in a direction parallel to the screwing axis.

According to still another aspect of the present invention, it is preferable that the connector further includes a movement-enabling mechanism configured to enable the electroconductive member and the terminal of the electric wire to move relative to the housing in a direction opposite to a direction in which the retraction mechanism does, wherein, when the first electrical-connection portion is still out of contact with the counterpart electrical-connection portion after the fixture portion makes contact with the fixture-portion receiving portion, the movement-enabling mechanism enables the electroconductive member and the terminal of the electric wire to move relative to the housing until the first electrical-connection portion comes in contact with the counterpart electrical-connection portion.

According to still another aspect of the present invention, it is preferable that the connector further includes a male screw member and a female screw member that are screw members together having a screwing axis set in parallel to directions in which the fitting portion is fit to and pulled out from the counterpart fitting portion, the male screw member and the female screw member being configured to fasten together the electrical-connection portion of the terminal fitting attached to the terminal of the electric wire and the second electrical-connection portion of the electroconductive member, wherein the retraction mechanism includes a protrusion that is a part of a first screw member that is one of the male screw member and the female screw member that have been screwed together, the part protruding from the second electrical-connection portion and the electrical-connection portion, and a retraction guide portion formed in the housing and capable of guiding the protrusion of the first screw member in a direction parallel to the screwing axis, and the movement-enabling mechanism includes a protrusion that is a part of a second screw member that is the other of the male screw member and the female screw member that have been screwed together, the part protruding from the second electrical-connection portion and the electrical-connection portion, and a movement-enabling guide portion formed in the housing and capable of guiding the protrusion of the second screw member in a direction parallel to the screwing axis.

According to still another aspect of the present invention, it is preferable that the male screw member and the female screw member that have been screwed together are used with a polygonal head of the male screw member serving as the protrusion of the retraction mechanism and with the polygonal female screw member as a whole serving as the protrusion of the movement-enabling mechanism, the housing includes a first screw accommodating compartment to accommodate the head of the male screw member and a second screw accommodating compartment to accommodate the female screw member, the first screw accommodating compartment is formed in a manner that allows the head to move relative to the housing in a direction parallel to the screwing axis to serve as the retraction guide portion, and the second screw accommodating compartment is formed in a manner that allows the female screw member to move relative to the housing in a direction parallel to the screwing axis to serve as the movement-enabling guide portion.

According to still another aspect of the present invention, it is preferable that the second screw accommodating compartment includes cutouts at corners formed between adjacent ones of inner circumferential faces thereof facing and lying next to individual outer circumferential faces of the female screw member, the cutouts being configured to accommodate corners formed between adjacent ones of the outer circumferential faces of the female screw member, and each of the cutouts has an arc-shaped face that connects the corresponding adjacent two inner circumferential faces.

According to still another aspect of the present invention, it is preferable that the fixture portion and the first electrical-connection portion are disposed offset from each other in the directions in which the fitting portion is fit into and pulled out of the counterpart fitting portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment of a connector according to the present invention in detail with reference to the drawings. This embodiment is not intended to limit this invention.

Embodiment

An embodiment of the connector according to the present invention is described with reference to FIG. 1 to FIG. 12.

Figure 1:
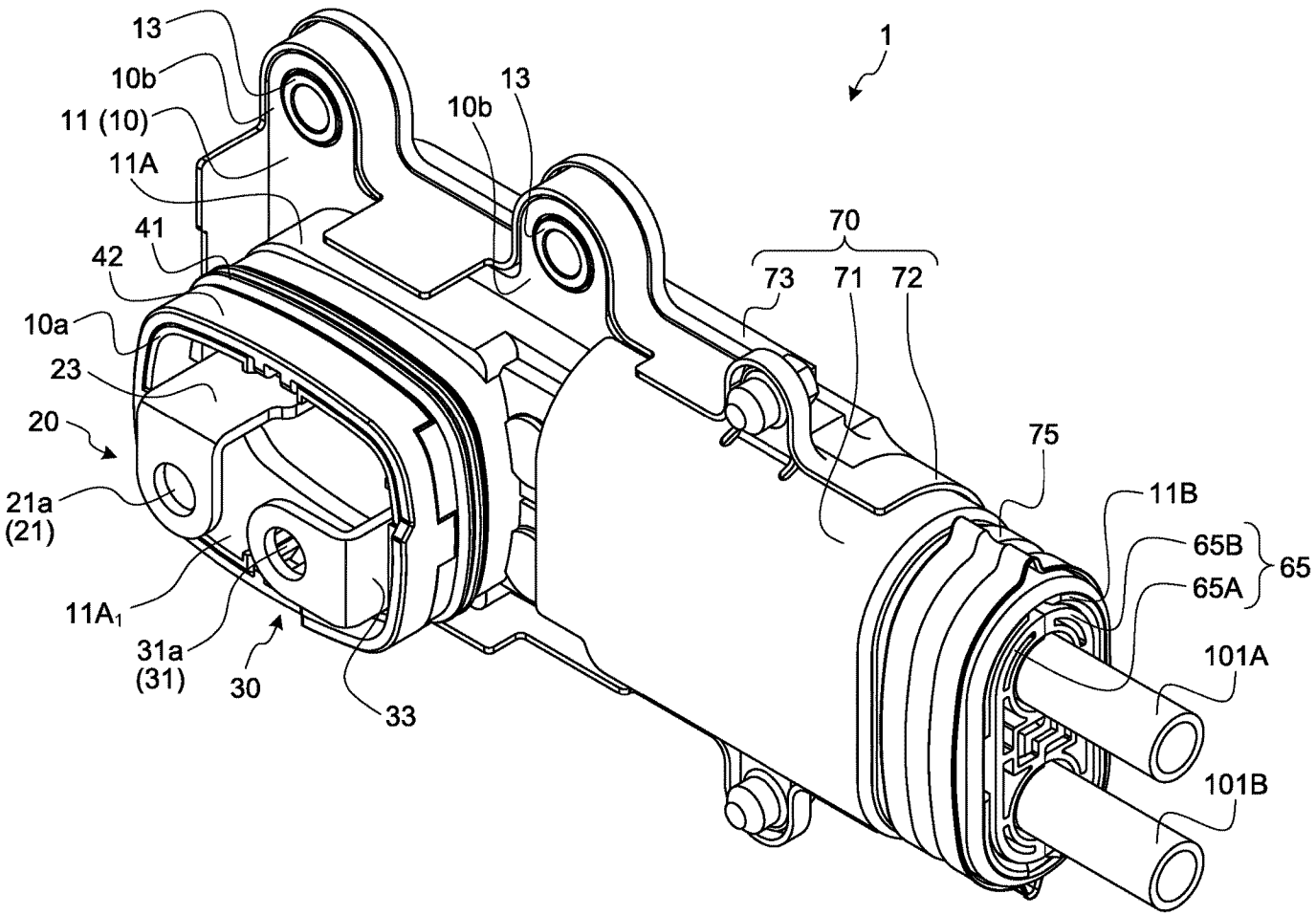
FIG. 1 is a perspective view illustrating a connector according to an embodiment.
Figure 2:
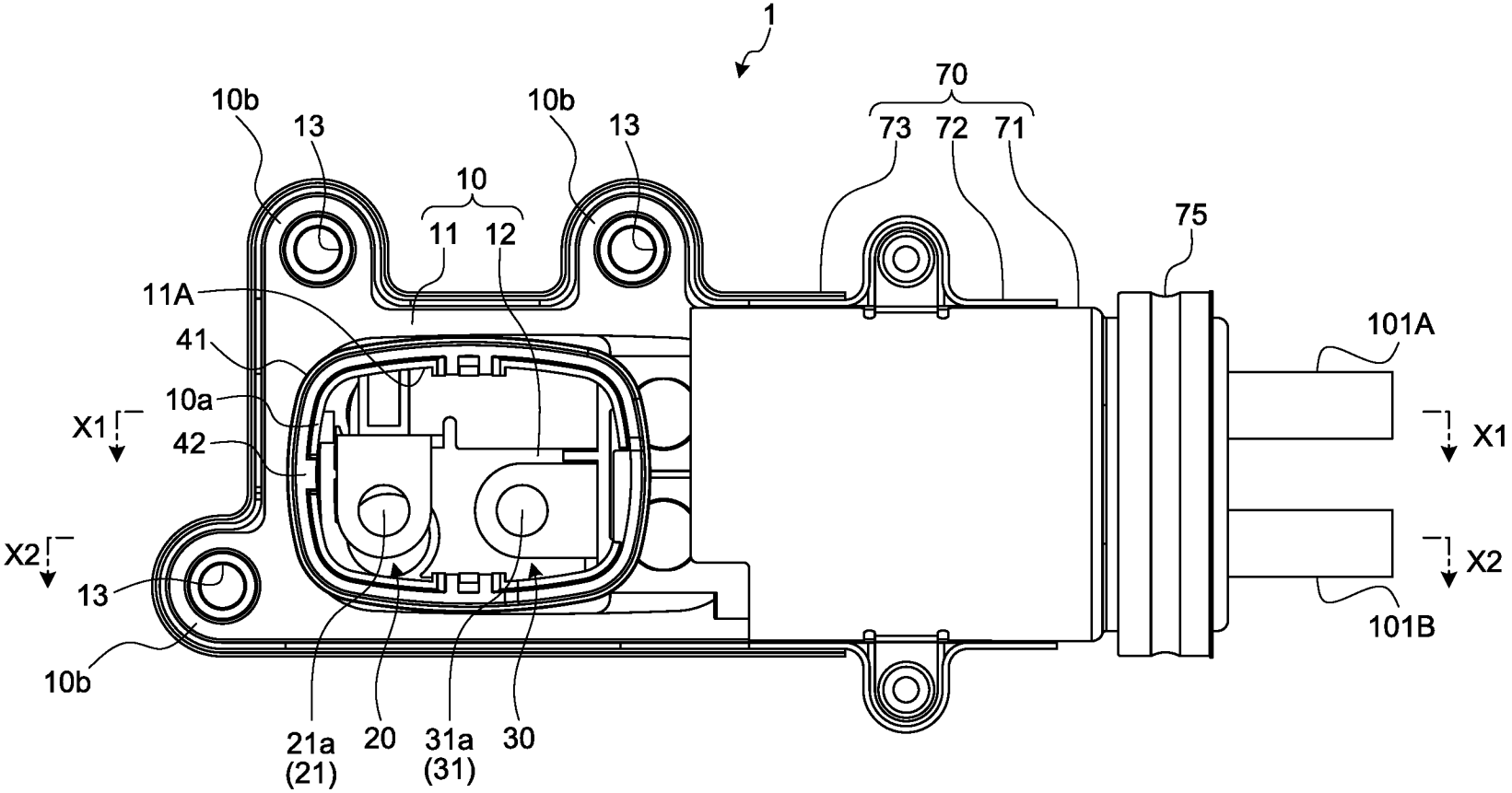
FIG. 2 is a plan view illustrating the connector according to the embodiment as viewed from a side thereof having a fitting portion.
Figure 3:
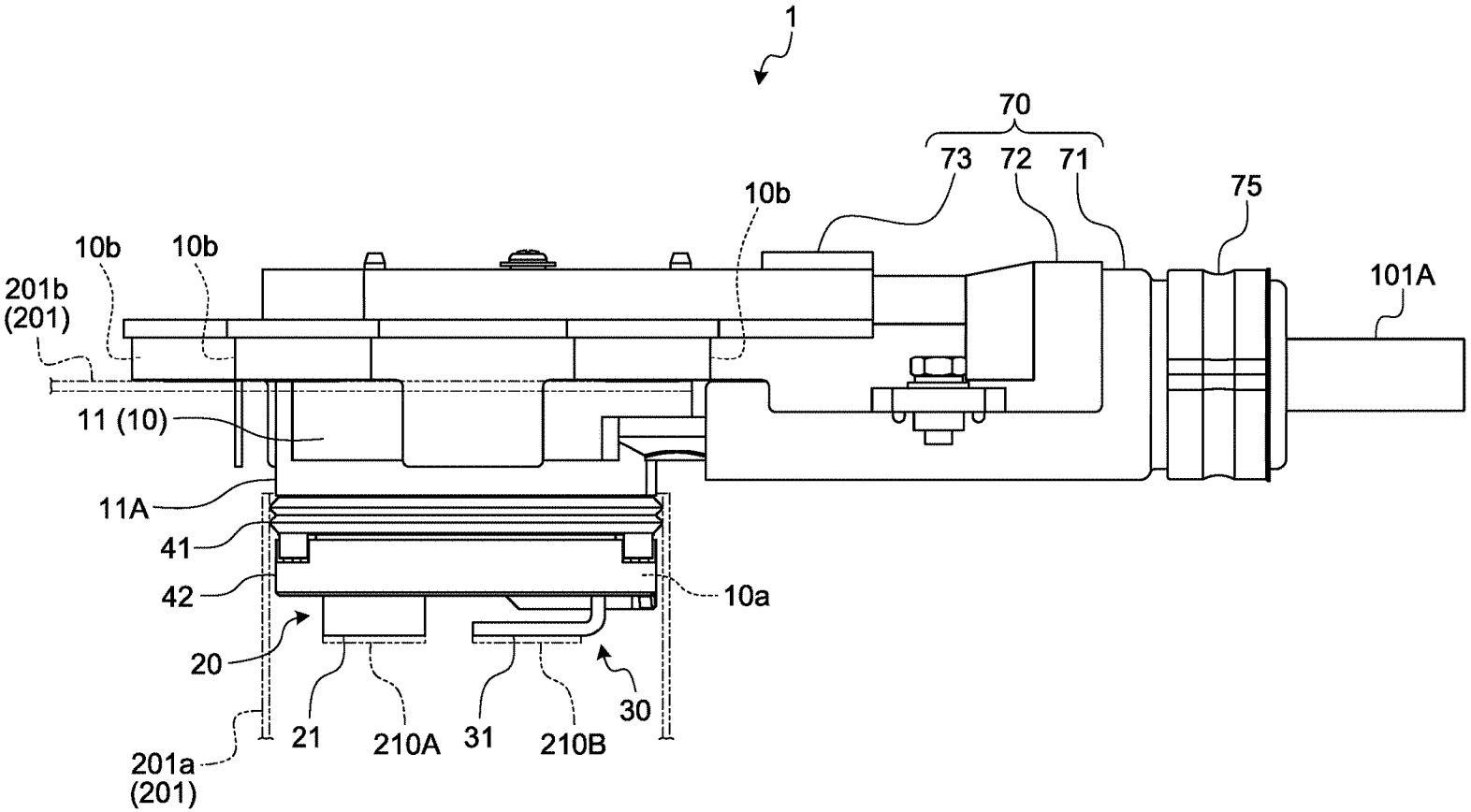
FIG. 3 is a plan view illustrating the connector according to the embodiment as viewed from another angle.

FIG. 1 to FIG. 3 illustrate a connector 1 in this embodiment. This connector 1 is to be connected to a counterpart connector (not illustrated) included in a device (not illustrated; hereinafter referred to as connection-target device) to which the connector 1 is to be connected through the counterpart connector. For example, in a vehicle (such as an electric vehicle or a hybrid vehicle) equipped with a rotating machine as a drive source, the rotating machine or an inverter is the connection-target device.

The connector 1 includes a housing 10 and a first and a second electroconductive members 20 and 30 (FIG. 1 to FIG. 6). In this connector 1, the first and the second electroconductive members 20 and 30 are accommodated in the interior of the housing 10, and respective terminals of a first and a second electric wires 101A and 101B are electrically connected to the first and the second electroconductive members 20 and 30 in positions deeper in the interior of the housing 10.

The housing 10 is formed of an insulating material such as a synthetic resin. The housing 10 illustrated here includes an accommodation member 11 and a covering member 12 (FIG. 6).

Figure 6:
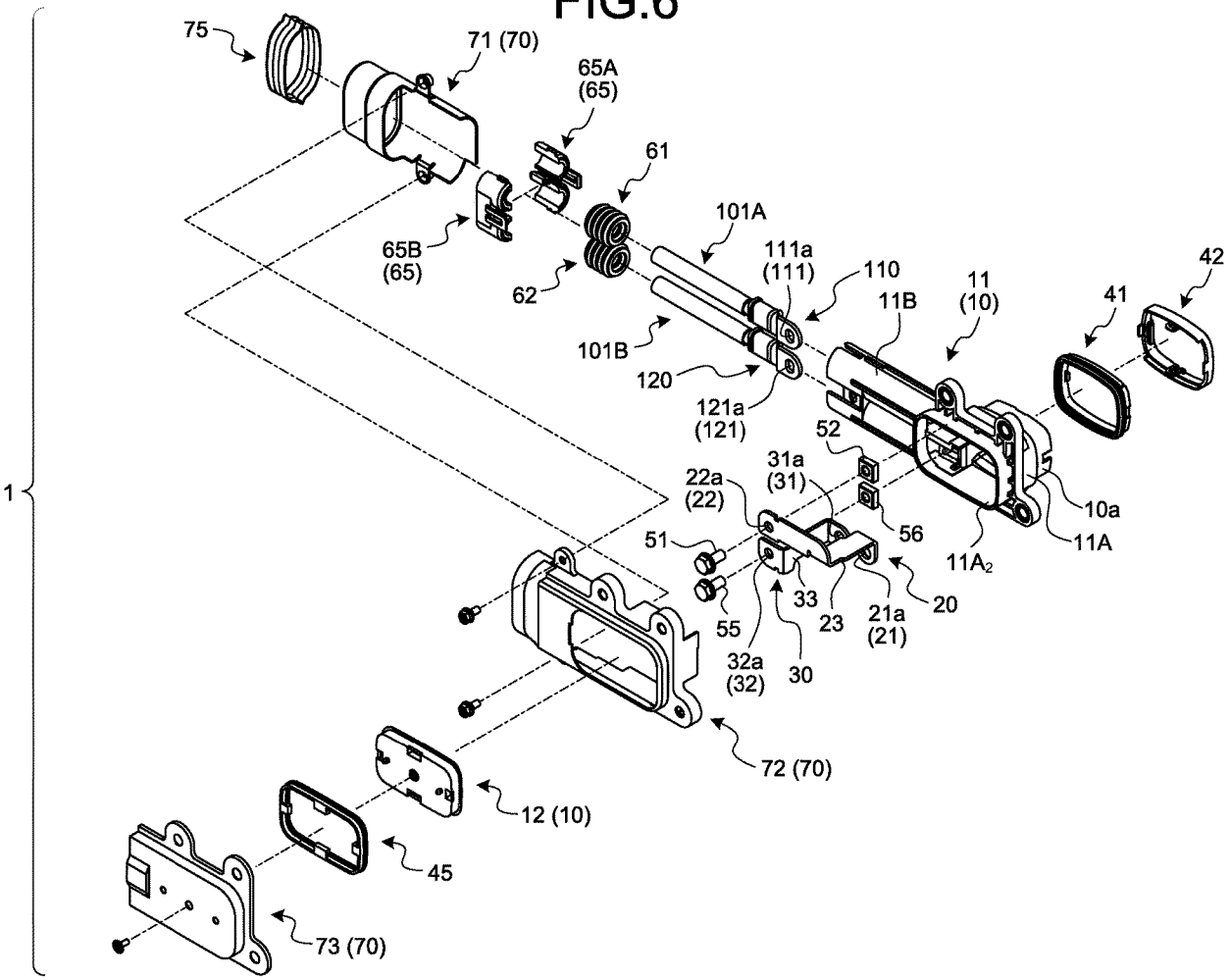
FIG. 6 is an exploded perspective view illustrating the connector according to the embodiment.

The accommodation member 11 includes a first accommodation body 11A having an angled cylindrical shape that holds the first and the second electroconductive members 20 and 30, and a second accommodation body 11B having an angled cylindrical shape that holds the first and the second electric wires 101A and 101B (FIG. 6).

One side of the first accommodation body 11A is used as a fitting portion 10*a*, the one side having an opening 11$A_1$ (FIG. 1). The fitting portion 10*a* is fit into a counterpart fitting portion 201*a* of a casing 201 of the connection-target device (FIG. 3). Herein, the cylindrical axis of the fitting portion 10*a* corresponds to directions in which the fitting portion 10*a* is fit into and pulled out of the counterpart fitting portion 201*a*. On the outer circumferential face of the fitting portion 10*a*, an annular sealing member 41 and an annular retaining member 42 are provided (FIG. 1 to FIG. 3). The sealing member 41 is provided so that the space between the fitting portion 10*a* and the counterpart fitting portion 201*a* can be kept proof against liquid. The retaining member 42 is used to retain the position of the sealing member 41 with respect to the fitting portion 10*a*, and presses the sealing member 41 from the opening 11$A_1$ side in a direction parallel to the cylindrical axis.

Figure 4:
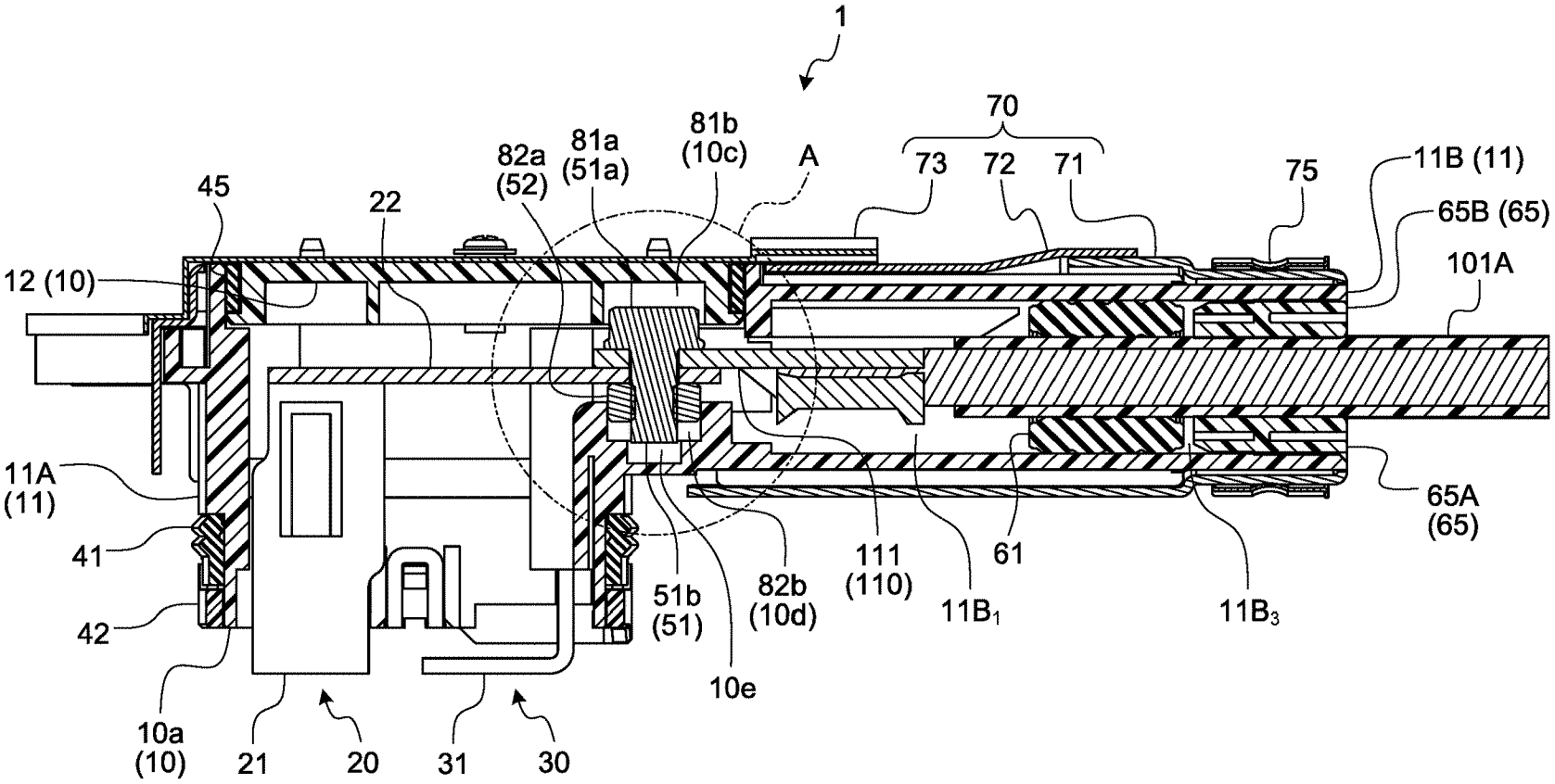
FIG. 4 is a sectional view taken along the X1-X1 of FIG. 2.
Figure 5:
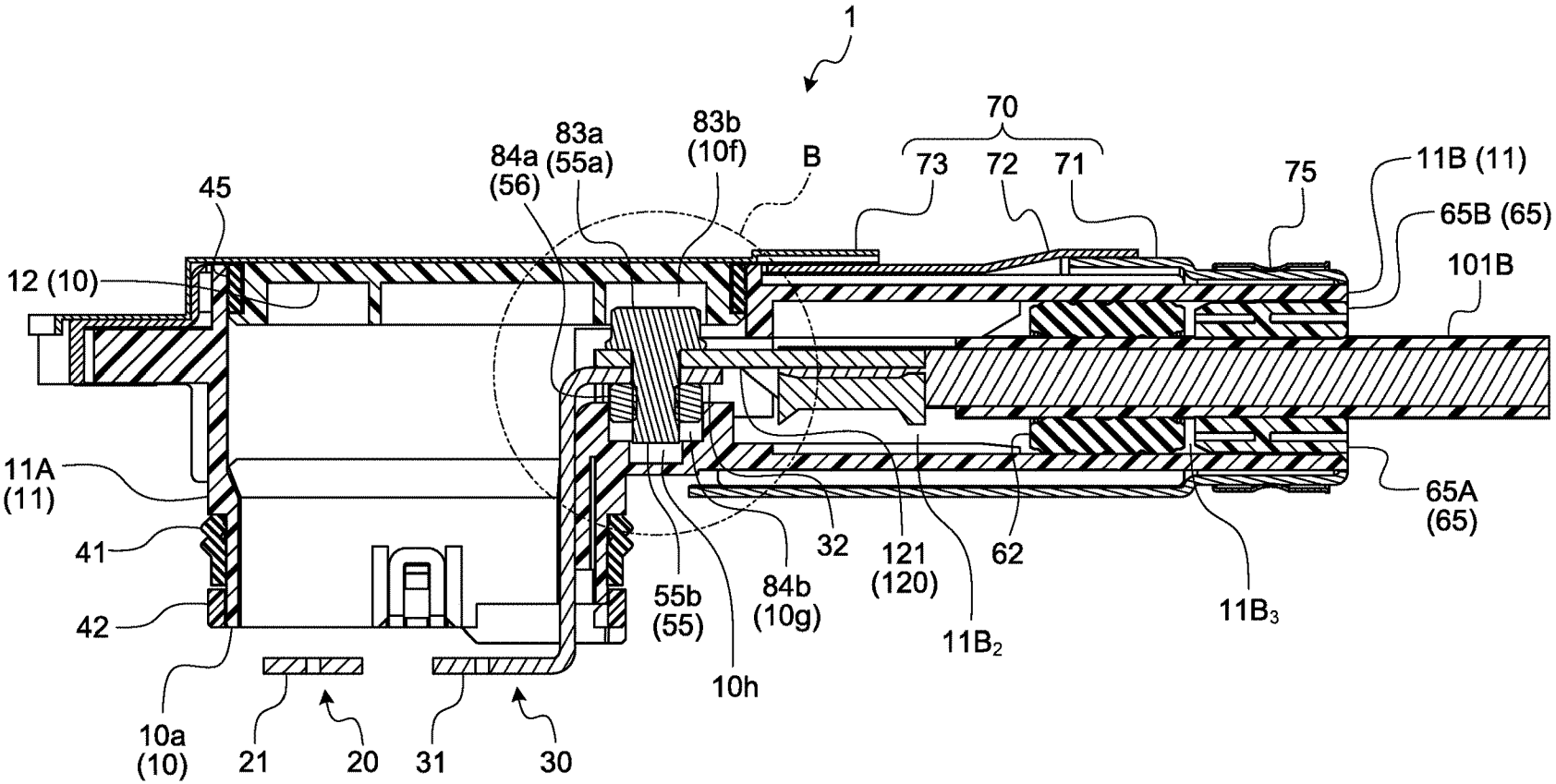
FIG. 5 is a sectional view taken along the X2-X2 of FIG. 2.

In the second accommodation body 11B, the first and the second electric wires 101A and 101B are held with axis lines thereof oriented parallel to the cylindrical axis of the second accommodation body 11B. In the interior of this second accommodation body 11B, a first accommodation compartment 11$B_1$ (FIG. 4) and a second accommodation compartment $11B_2$ (FIG. 5) are formed that accommodate the first electric wire 101A and the second electric wire 101B, respectively. The first accommodation compartment $11B_1$ and the second accommodation compartment $11B_2$ are each formed in a circular cylindrical shape, and are arranged next to each other in a direction perpendicular both to the cylindrical-axis direction of the second accommodation body 11B and to the directions in which to fit and pull out the fitting portion 10*a*. A third accommodation compartment $11B_3$ communicating with the first accommodation compartment $11B_1$ and the second accommodation compartment $11B_2$ is formed in the free-end side of this second accommodation body 11B (FIG. 4 and FIG. 5). The third accommodation compartment $11B_3$ accommodates a rear holder 65 described later. The first and the second electric wires 101A and 101B are led to the outside through the first and the second accommodation compartments $11B_1$ and $11B_2$ and through the third accommodation compartment $11B_3$.

In this accommodation member 11, the first accommodation body 11A and the second accommodation body 11B are arranged with the cylindrical axes thereof being perpendicular to each other. In this example, the second accommodation body 11B is extended from one of the four circumferential walls of the first accommodation body 11A. Through the one circumferential wall, the first and the second accommodation compartments $11B_1$ and $11B_2$ communicate with a space in the interior of the first accommodation body 11A.

The covering member 12 is a member blocking an opening $11A_2$ (FIG. 6) in the other side of the first accommodation body 11A and is formed in a rectangular plate-like shape. On the outer circumferential face of this covering member 12, an annular sealing member 45 is provided. The sealing member 45 is provided so that the space between the covering member 12 and the inner circumferential face of the first accommodation body 11A can be kept proof against liquid.

After the completion of fitting the fitting portion 10*a* into the counterpart fitting portion 201*a*, this housing 10 is secured to the casing 201 of the connection-target device. This housing 10 is provided with fixture portions 10*b* to be secured to fixture-portion receiving portions 201*b* of the casing 201 (FIG. 1 to FIG. 3). Here, the first accommodation body 11A are provided with three fixture portions 10*b*. Each of the fixture portions 10*b* and the corresponding fixture-portion receiving portion 201*b* are brought into contact with each other and secured to each other with a screw during the progress of fitting the fitting portion 10*a* into the counterpart fitting portion 201*a*. For example, the fixture portions 10*b* is provided with a circular cylindrical collar member 13 having an axis line oriented along the direction in which to fit the fitting portion 10*a* (FIG. 2). Each of the fixture-portion receiving portions 201*b* is provided with a female screw member (not illustrated) such as a nut. The housing 10 is secured to the casing 201 of the connection-target device in a manner such that: the fixture portions 10*b* are brought into contact with the corresponding fixture-portion receiving portions 201*b* during the progress of fitting the fitting portion 10*a*; and male screw members (not illustrated) inserted through the interior of and coaxially with the corresponding collar members 13 are screwed into the female screw members of the corresponding fixture-portion receiving portions 201*b*.

The first and the second electroconductive members 20 and 30 are each formed of an electroconductive material such as a metal. Herein, what is called a busbar, which is obtained by pressing a metal plate used as a base material therefor, is presented as each of the first and the second electroconductive members 20 and 30.

The first electroconductive member 20 has a first electrical-connection portion 21 to be electrically connected to a first counterpart electrical-connection portion 210A (FIG. 3), and a second electrical-connection portion 22 electrically connected to the terminal of the first electric wire 101A (FIG. 6). The first counterpart electrical-connection portion 210A is, for example, a part of a terminal included in the connection-target device. The first counterpart electrical-connection portion 210A is provided to the counterpart fitting portion 201*a*. The first electroconductive member 20 has the first electrical-connection portion 21 and the second electrical-connection portion 22 formed as fragment pieces and joined to each other by a joint portion 23 formed as a fragment piece.

This first electroconductive member 20 is disposed in the interior of the first accommodation body 11A so that a direction perpendicular to a flat surface of the first electrical-connection portion 21 can be oriented along the direction in which to fit the fitting portion 10*a*. This first electroconductive member 20 is disposed also so that a direction perpendicular to a flat surface of the second electrical-connection portion 22 can be oriented along the direction in which to fit the fitting portion 10*a*. The first electroconductive member 20 in this example is obtained by folding an L-shaped piece over at 90 degrees in two locations, the L-shaped piece having been formed into an L shape through a punch-out process. One end portion of this L shape in the free-end side of one straight segment of the L shape is folded over, and the folded-over end portion is used as the first electrical-connection portion 21. The other end portion of the L-shape and the rest of the other straight segment thereof are folded over together, and the other end portion is used as the second electrical-connection portion 22. Herein, the first electrical-connection portion 21 and the second electrical-connection portion 22 are folded over in opposite directions. The first accommodation body 11A has in the interior thereof: the first electrical-connection portion 21 disposed closer to the opening $11A_1$ than to the other opening; the joint portion 23 disposed extending from one edge of this first electrical-connection portion 21 in the directions in which the fitting portion 10*a* is fit into and pulled out of the counterpart fitting portion 201*a*; and the second electrical-connection portion 22 disposed extending from one edge of this joint portion 23 toward the second accommodation body 11B. Extending in the direction along the axis line of the terminal of the first electric wire 101A, the second electrical-connection portion 22 is joined to the first electric wire 101A at an end portion thereof toward which the second electrical-connection portion 22 thus extends.

The first electrical-connection portion 21 is electrically connected to the first counterpart electrical-connection portion 210A by being brought into contact with the first counterpart electrical-connection portion 210A during the progress of fitting the fitting portion 10*a* into the counterpart fitting portion 201*a*. Herein, the first counterpart electrical-connection portion 210A is also formed as a fragment piece, and the first electrical-connection portion 21 and the first counterpart electrical-connection portion 210A are brought into contact with each other through respective flat surfaces thereof. The first electrical-connection portion 21 and the first counterpart electrical-connection portion 210A are secured to each other by being screwed together, so as to be thereafter kept in contact with each other. The screwing uses a male screw member (not illustrated) and a female screw member (not illustrated) together having a screwing axis set parallel to the direction in which to fit the fitting portion 10*a*. For this reason, the first electrical-connection portion 21 has a through-hole 21*a* formed therein (FIG. 1, FIG. 2, and FIG. 6). For example, in the case of the first counterpart electrical-connection portion 210A provided with a male screw member such as a stud bolt, the male screw member is inserted through the through-hole 21*a* during the progress of fitting the fitting portion 10*a*, and a female screw member is screwed on the male screw member after the first electrical-connection portion 21 and the first counterpart electrical-connection portion 210A are brought into contact with each other. Otherwise, in the case of the first counterpart electrical-connection portion 210A provided with a female screw member such as a weld nut, a male screw member is screwed into the female screw member after the first electrical-connection portion 21 and the first counterpart electrical-connection portion 210A are brought into contact with each other during the progress of fitting the fitting portion 10*a*.

The second electrical-connection portion 22 has a through-hole 22*a* formed therein in the above-described end portion thereof toward which it extends (FIG. 6). To this second electrical-connection portion 22, an electrical-connection portion 111 of a terminal fitting 110 is connected via this through-hole 22*a*, and the first electric wire 101A is connected via this terminal fitting 110. The terminal fitting 110 is an electroconductive member attached to the terminal of the first electric wire 101A. This terminal fitting 110 is physically and electrically connected to the terminal of the first electric wire 101A through a pressure bonding process such as swaging. The terminal fitting 110 in this example is what is called a round terminal, and the electrical-connection portion 111 has a through-hole 111*a* formed therein. The second electrical-connection portion 22 and the electrical-connection portion 111 are secured to each other with screw members the screwing axis of which has been set parallel to the directions in which to fit and pull out the fitting portion 10*a*. For this reason, this connector 1 includes a male screw member 51 and a female screw member 52 for fastening the second electrical-connection portion 22 and the electrical-connection portion 111 to each other (FIG. 4 and FIG. 6). The second electrical-connection portion 22 and the electrical-connection portion 111 are physically and electrically connected to each other in a manner such that: respective flat surfaces thereof are brought into contact with each other so that the through-holes 22*a* and 111*a* thereof can be concentrically disposed; and the female screw member 52 is screwed on the male screw member 51 inserted through both of the through-holes 22*a* and 111*a*.

The second electroconductive member 30 has a first electrical-connection portion 31 to be electrically connected to a second counterpart electrical-connection portion 210B (FIG. 3), and a second electrical-connection portion 32 electrically connected to the terminal of the second electric wire 101B (FIG. 6). The second counterpart electrical-connection portion 210B is, for example, a part of a terminal included in the connection-target device. In the similar manner to the first counterpart electrical-connection portion 210A, this second counterpart electrical-connection portion 210B is provided to the counterpart fitting portion 201*a*. The second electroconductive member 30 has the first electrical-connection portion 31 and the second electrical-connection portion 32 formed as fragment pieces and joined to each other by a joint portion 33 formed as a fragment piece.

This second electroconductive member 30 is disposed in the interior of the first accommodation body 11A so that a direction perpendicular to a flat surface of the first electrical-connection portion 31 can be oriented along the direction in which to fit the fitting portion 10*a*. This second electroconductive member 30 is disposed also so that a direction perpendicular to a flat surface of the second electrical-connection portion 32 can be oriented along the direction in which to fit the fitting portion 10*a*. The second electroconductive member 30 in this example is obtained by folding both end portions of a rectangular piece over at 90 degrees in two locations, the rectangular piece having been formed into a linear shape through a punch-out process. One end portion of this rectangular piece is used as the first electrical-connection portion 31. The other end portion thereof is used as the second electrical-connection portion 32. The first accommodation body 11A has in the interior thereof: the first electrical-connection portion 31 disposed closer to the opening $\mathbf{11}A_1$ than to the other opening; the joint portion 33 disposed extending from one edge of this first electrical-connection portion 31 in the directions in which to fit and pull out the fitting portion 10*a*; and the second electrical-connection portion 32 disposed extending from one edge of this joint portion 33 toward the second accommodation body 11B.

The first electrical-connection portion 31 is electrically connected to the second counterpart electrical-connection portion 210B by being brought into contact with the second counterpart electrical-connection portion 210B along with the progress of fitting of the fitting portion 10*a* into the counterpart fitting portion 201*a*. Herein, the second counterpart electrical-connection portion 210B is also formed as a fragment piece, and the first electrical-connection portion 31 and the second counterpart electrical-connection portion 210B are brought into contact with each other through respective flat surfaces thereof. As with the first electroconductive member 20, the first electrical-connection portion 31 and the second counterpart electrical-connection portion 210B are secured to each other by being screwed, so as to be thereafter kept in contact with each other. For this reason, the first electrical-connection portion 31 has a through-hole 31*a* formed therein (FIG. 1, FIG. 2, and FIG. 6).

The second electrical-connection portion 32 has a through-hole 32*a* formed therein (FIG. 6). To this second electrical-connection portion 32, an electrical-connection portion 121 of a terminal fitting 120 is connected via this through-hole 32*a*, and the second electric wire 101B is connected via this terminal fitting 120. The terminal fitting 120 is an electroconductive member attached to the terminal of the second electric wire 101B. This terminal fitting 120 is physically and electrically connected to the terminal of the second electric wire 101B through a pressure bonding process such as swaging. The terminal fitting 120 in this example is what is called a round terminal, and the electrical-connection portion 121 has a through-hole 121*a* formed therein. The second electrical-connection portion 32 and the electrical-connection portion 121 are secured to each other with screw members the screwing axis of which has been set parallel to the directions in which to fit and pull out the fitting portion 10*a*. For this reason, this connector 1 includes a male screw member 55 and a female screw member 56 for fastening the second electrical-connection portion 32 and the electrical-connection portion 121 to each other (FIG. 5 and FIG. 6). The second electrical-connection portion 32 and the electrical-connection portion 121 are physically and electrically connected to each other in a manner such that: respective flat surfaces thereof are brought into contact with each other so that the through-holes 32*a* and 121*a* thereof can be concentrically disposed; and the female screw member 56 is screwed on the male screw member 55 inserted through both of the through-holes 32*a* and 121*a*.

In this connector 1, the first electrical-connection portion 21 of the first electroconductive member 20 and the first electrical-connection portion 31 of the second electroconductive member 30 are disposed side by side with a space therebetween. Herein, the first electrical-connection portion 21 and the first electrical-connection portion 31 are arranged side by side in the direction along the axis lines of the first and the second electric wires 101A and 101B. In this connector 1, the second electrical-connection portion 22 of the first electroconductive member 20 and the second electrical-connection portion 32 of the second electroconductive member 30 are also disposed side by side with a space therebetween. Herein, the second electrical-connection portion 22 and the second electrical-connection portion 32 are arranged next to each other in a direction in which the first accommodation compartment 11$B_1$ and the second accommodation compartment 11$B_2$ are arranged next to each other.

In this connector 1, the housing 10 supports a connected body formed of the first electroconductive member 20 and the first electric wire 101A and a connected body of the second electroconductive member 30 and the second electric wire 101B in the following manner.

A circular cylindrical sealing member 61 concentric with the outer circumferential face of the first electric wire 101A and the inner circumferential face of the first accommodation compartment 11$B_1$ is provided therebetween (FIG. 4 and FIG. 6). The sealing member 61 is provided with a plurality of lips on each of the inner and outer circumferential faces thereof. While the lips on the inner circumferential face thereof are attached firmly to the outer circumferential face of the first electric wire 101A, the lips on the outer circumferential face thereof are attached firmly to the inner circumferential face of the first accommodation compartment 11$B_1$. Thus, the first electric wire 101A is retained by the first accommodation compartment 11$B_1$ with the sealing member 61. Consequently, the connected body formed of the first electroconductive member 20 and the first electric wire 101A are retained in the housing 10 with the sealing member 61. Likewise, a circular cylindrical sealing member 62 concentric with the outer circumferential face of the second electric wire 101B and the inner circumferential face of the second accommodation compartment 11$B_2$ is provided therebetween (FIG. 5 and FIG. 6). The sealing member 62 is provided with a plurality of lips on each of the inner and outer circumferential faces thereof. While the lips on the inner circumferential face thereof are attached firmly to the outer circumferential face of the second electric wire 101B, the lips on the outer circumferential face thereof are attached firmly to the inner circumferential face of the second accommodation compartment 11$B_2$. Thus, the second electric wire 101B is retained by the second accommodation compartment 11$B_2$ with the sealing member 62. Consequently, the connected body formed of the second electroconductive member 30 and the second electric wire 101B are retained in the housing 10 with the sealing member 62.

The rear holder 65 (FIG. 6) accommodated in the third accommodation compartment 11$B_3$ regulates the positions of the respective sealing members 61 and 62 in directions along the axis lines thereof in the first accommodation compartment 11$B_1$ and the second accommodation compartment 11$B_2$. The rear holder 65 in this example is composed of separated bodies 65A and 65B, that is, two parts into which the rear holder 65 is separated. The first electric wire 101A and the second electric wire 101B are sandwiched between the separate bodies 65A and 65B.

This connector 1 is covered with a shielding member 70 for preventing noise from intruding therein (FIG. 1 to FIG. 6). The shielding member 70 is formed of an electroconductive material such as a metal. In this example, the shielding member 70 has a three-part divided structure composed of first to third shielding members 71 to 73. The housing 10 is covered with the first to the third shielding members 71 to 73 from the outside with the fitting portion 10*a* exposed. To this shielding member 70 (the first shielding member 71), a braid (not illustrated) swaged with an electroconductive annular member 75 is electrically connected. The braid is an electroconductive member braided into a cylindrical shape, and covers externally drawn-out parts of the first electric wire 101A and the second electric wire 101B, the parts being drawn out externally.

In the connector 1 in this embodiment, the position of the first electric wire 101A relative to the sealing member 61 can be adjusted both in the direction along the axis line of the first electric wire 101A and in a direction about the axis of the first electric wire 101A. Such adjustment of the position allows the through-hole 21*a* of the first electrical-connection portion 21 to be positioned concentrically with the screwing axis of the aforementioned screw member. Likewise, in the connector 1 in this embodiment, the position of the second electric wire 101B relative to the sealing member 62 can be adjusted both in the direction along the axis line of the second electric wire 101B and in a direction about the axis of the second electric wire 101B. Such adjustment of the position allows the through-hole 31*a* of the first electrical-connection portion 31 to be positioned concentrically with the screwing axis of the aforementioned screw member.

One possible risk here is that, in the first electroconductive member 20, if the first electrical-connection portion 21 makes contact with the first counterpart electrical-connection portion 210A before the fixture portion 10*b* makes contact with the fixture-portion receiving portion 201*b*, excess loads act on the first electrical-connection portion 21 and the first counterpart electrical-connection portion 210A during fixation by screwing between the fixture portion 10*b* and the fixture-portion receiving portion 201*b*. Another possible risk is that, in the first electroconductive member 20, if the first electrical-connection portion 21 is still out of contact with the first counterpart electrical-connection portion 210A after the fixture portion 10*b* makes contact with the fixture-portion receiving portion 201*b*, excess loads act on the first electrical-connection portion 21 and the first counterpart electrical-connection portion 210A during fixation by screwing between the first electrical-connection portion 21 and the first counterpart electrical-connection portion 210A. Also in the second electroconductive member 30, such excess loads can act similarly on the first electrical-connection portion 31 and the second counterpart electrical-connection portion 210B. These excess loads can further act on the housing 10 and the casing 201 in the form of reaction force.

For this reason, the connector 1 in this embodiment not only has the through-hole 21*a* disposed in the first electrical-connection portion 21 concentrically with the screwing axis of a screw member but also includes at least one position adjustment mechanism that enables adjustment of the position of the first electrical-connection portion 21 relative to the first counterpart electrical-connection portion 210A. The connector 1 in this embodiment not only has the through-hole 31*a* disposed in the first electrical-connection portion 31 concentrically with the screwing axis of a screw member but also includes a position adjustment mechanism that enables adjustment of the position of the first electrical-connection portion 31 relative to the second counterpart electrical-connection portion 210B.

As the position adjustment mechanism for the first electroconductive member 20, a first position adjustment mechanism (hereinafter referred to as "retraction mechanism") 81 and a second position adjustment mechanism (hereinafter referred to as "movement-enabling mechanism") 82 (FIG. 7) are included. The retraction mechanism 81 enables the first electroconductive member 20 and the terminal of the first electric wire 101A to move relative to and retract from each other in the interior of the housing 10 while the fitting portion 10*a* is being fit into the counterpart fitting portion 201*a*. The movement-enabling mechanism 82 enables the first electroconductive member 20 and the terminal of the first electric wire 101A to move relative to the housing 10 and be drawn nearer to the first counterpart electrical-connection portion 210A in the interior of the housing 10 after the fitting portion 10*a* is fit into the counterpart fitting portion 201*a*. As the position adjustment mechanism for the second electroconductive member 30, a first position adjustment mechanism (hereinafter referred to as "retraction mechanism") 83 and a second position adjustment mechanism (hereinafter referred to as "movement-enabling mechanism") 84 (FIG. 8) are included. The retraction mechanism 83 enables the second electroconductive member 30 and the terminal of the second electric wire 101B to move relative to and retract from each other in the interior of the housing 10 while the fitting portion 10*a* is being fit into the counterpart fitting portion 201*a*. The movement-enabling mechanism 84 enables the second electroconductive member 30 and the terminal of the second electric wire 101B to move relative to the housing 10 and be drawn nearer to the second counterpart electrical-connection portion 210B in the interior of the housing 10 after the fitting portion 10*a* is fit into the counterpart fitting portion 201*a*.

The retraction mechanism 81 and the movement-enabling mechanism 82 in the first electroconductive member 20 are described first.

The retraction mechanism 81 is configured so that, when the first electrical-connection portion 21 makes contact with the first counterpart electrical-connection portion 210A before the fixture portion 10*b* makes contact with the fixture-portion receiving portion 201*b*, the first electroconductive member 20 and the terminal of the first electric wire 101A can be, until the fixture portion 10*b* makes contact with the fixture-portion receiving portion 201*b*, retracted in a certain direction with the first electrical-connection portion 21 kept in contact with the first counterpart electrical-connection portion 210A, the certain direction being opposite to the direction in which to fit the fitting portion 10*a*. The retraction mechanism 81 in this example includes: a protrusion 81*a* that is a part of one of the male screw member 51 and the female screw member 52 that have been screwed together, the part protruding from the second electrical-connection portion 22 and the electrical-connection portion 111; and a guide portion (hereinafter referred to as "retraction guide portion") 81*b* provided in the housing 10 and capable of guiding the protrusion 81*a* in a direction parallel to the screwing axis of these screw members (FIG. 4 and FIG. 7).

The movement-enabling mechanism 82 is configured so that, when the first electrical-connection portion 21 is still out of contact with the first counterpart electrical-connection portion 210A after the fixture portion 10*b* makes contact with the fixture-portion receiving portion 201*b*, the first electroconductive member 20 and the terminal of the first electric wire 101A can move relative to the housing 10 until the first electrical-connection portion 21 makes contact with the first counterpart electrical-connection portion 210A. That is, this movement-enabling mechanism 82 moves the first electroconductive member 20 and the terminal of the first electric wire 101A relative to the housing 10 in a direction opposite to the direction in which the retraction mechanism 81 does. The movement-enabling mechanism 82 in this example includes: a protrusion 82*a* that is a part of the other of the male screw member 51 and the female screw member 52 that have been screwed together, the part protruding from the second electrical-connection portion 22 and the electrical-connection portion 111; and a guide portion (hereinafter referred to as "movement-enabling guide portion") 82*b* provided in the housing 10 and capable of guiding the protrusion 82*a* in a direction parallel to the screwing axis of these screw members (FIG. 4 and FIG. 7).

Figure 7:
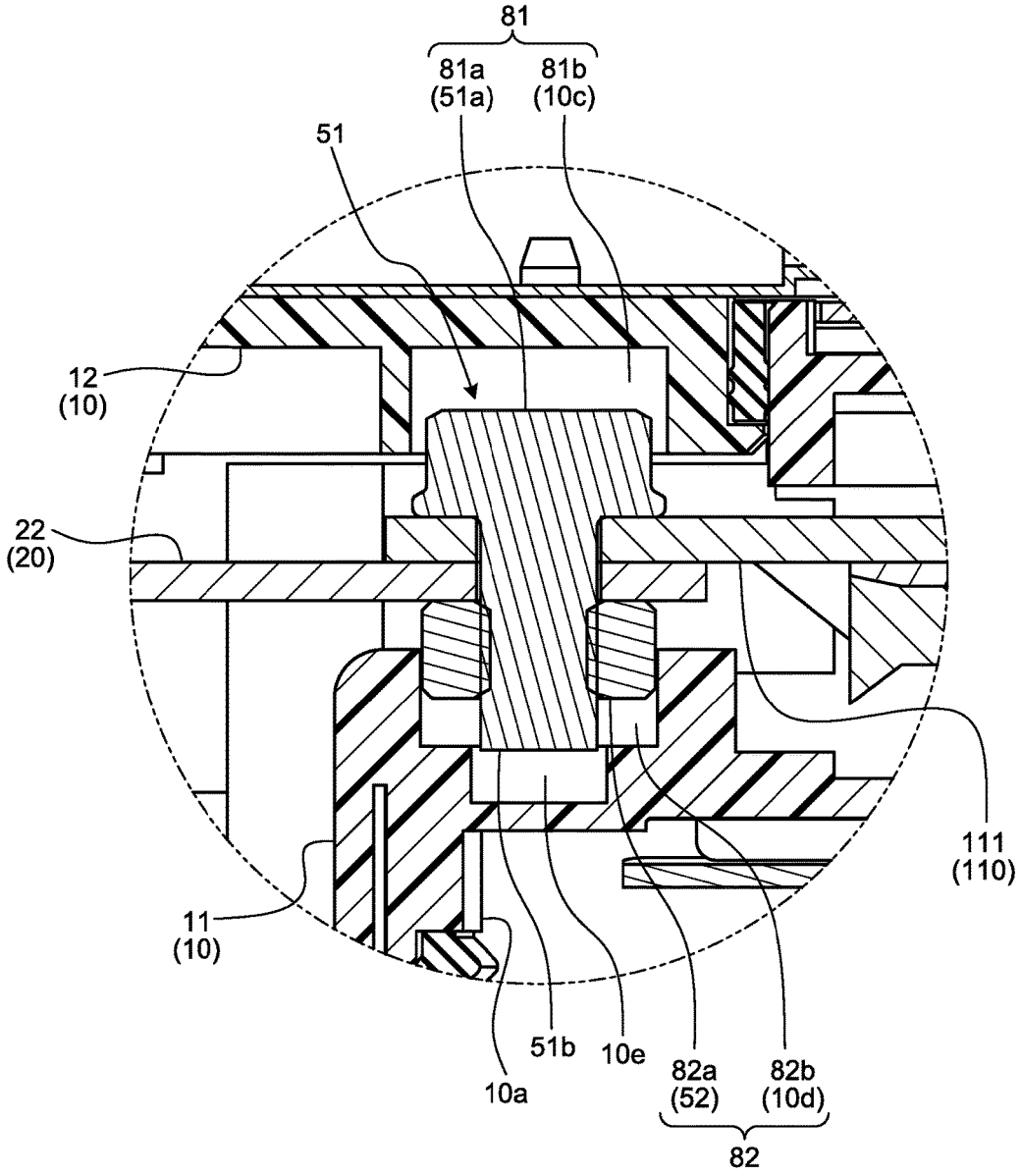
FIG. 7 is an enlarged view of the part A of FIG. 4.

The male screw member 51 and the female screw member 52 that have been screwed together are used with a polygonal (hexagonal in this example) head 51*a* of the male screw member 51 serving as the protrusion 81*a* of the retraction mechanism 81 and with the polygonal (rectangular in this example) female screw member 52 as a whole used as the protrusion 82*a* of the movement-enabling mechanism 82 (FIG. 4 and FIG. 7).

Figure 9:
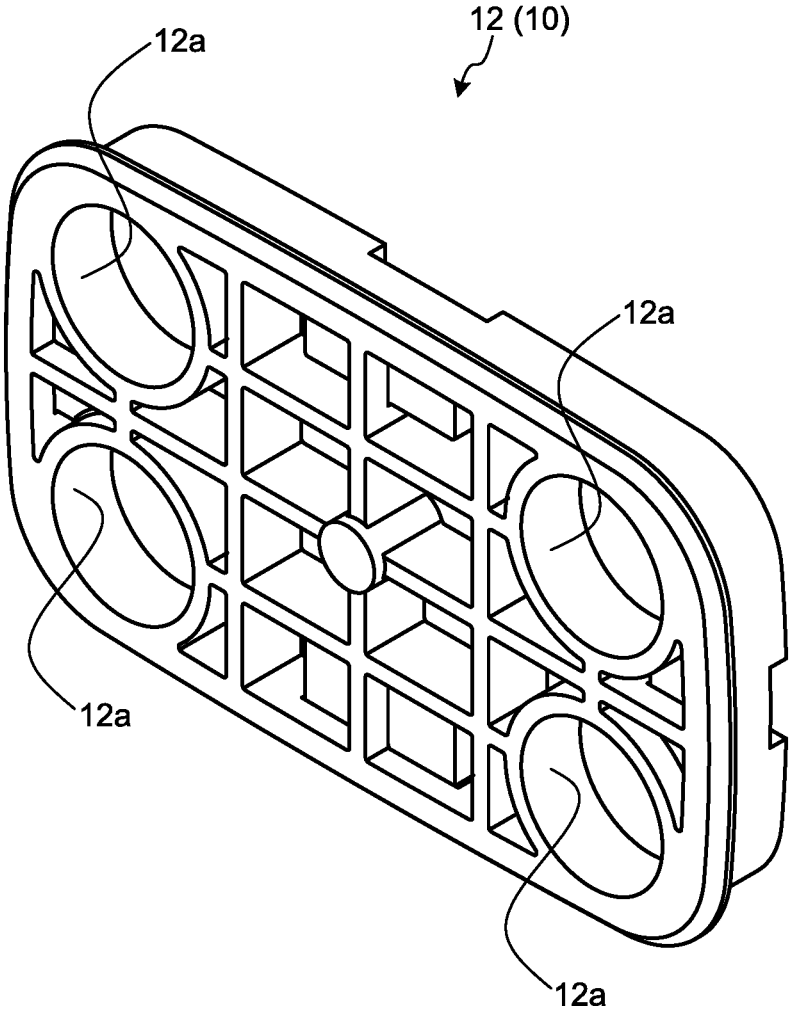
FIG. 9 is a perspective view illustrating a covering member of a housing.
Figure 10:
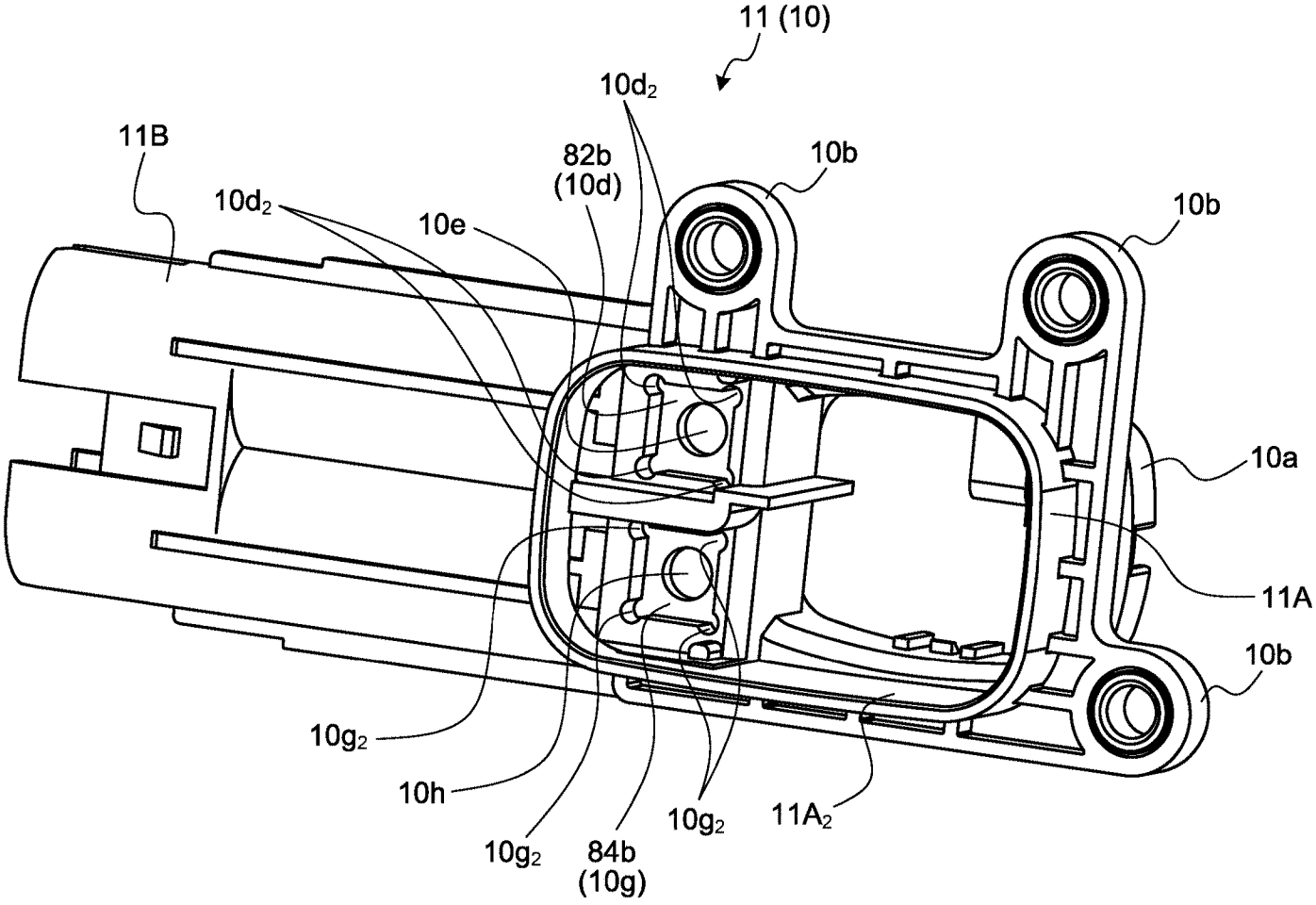
FIG. 10 is a perspective view illustrating an accommodation member of the housing.
Figure 11:
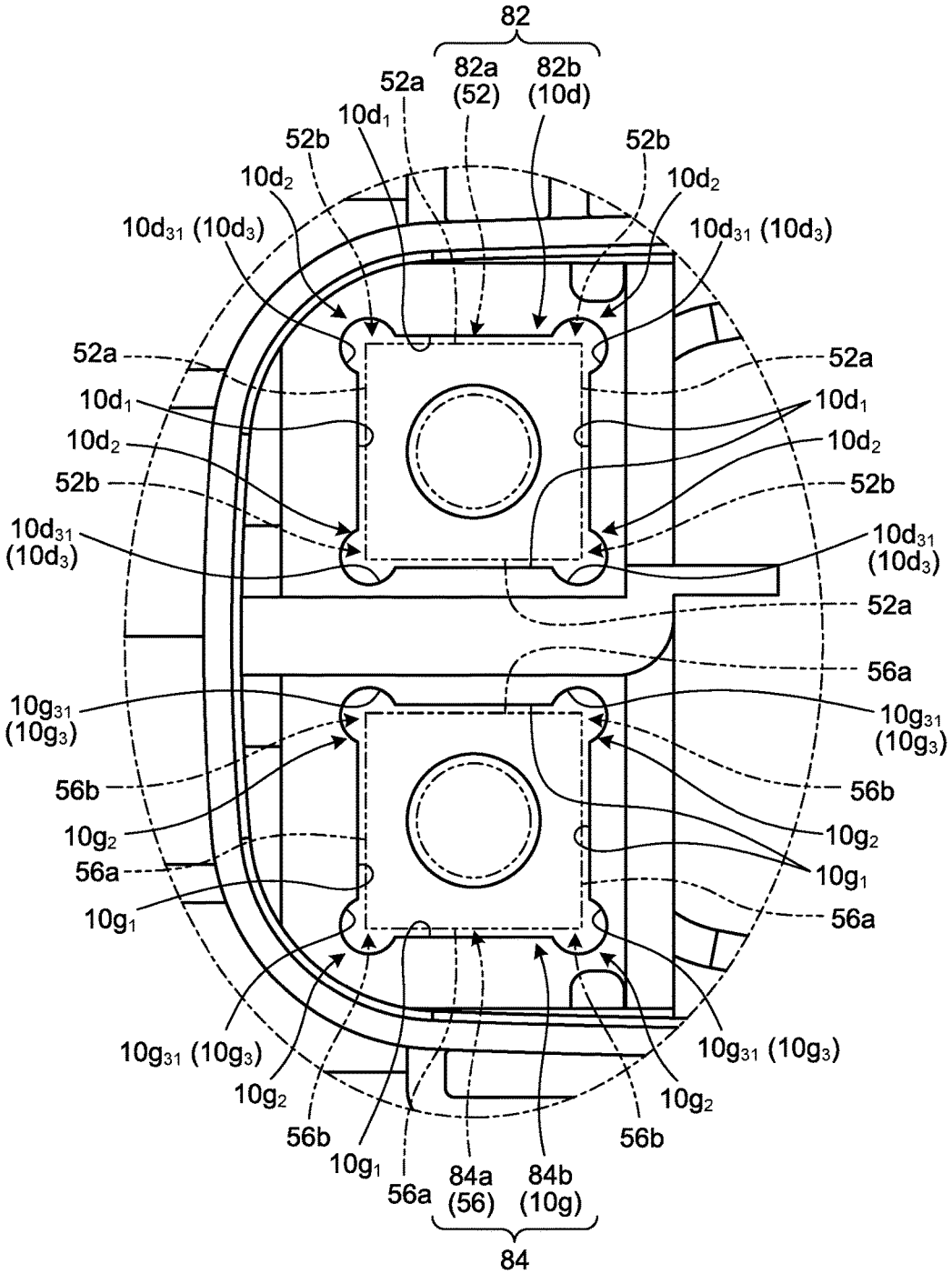
FIG. 11 is a plan view illustrating a second screw accommodating compartment of the accommodation member.

The housing 10 is provided with: a first screw accommodating compartment 10*c* to accommodate the head 51*a* of the male screw member 51; and a second screw accommodating compartment 10*d* to accommodate the female screw member 52 (FIG. 4 and FIG. 7). In this example, the first screw accommodating compartment 10*c* is used as the retraction guide portion 81*b*, and the second screw accommodating compartment 10*d* is used as the movement-enabling guide portion 82*b*. For this reason, in the housing 10, the first screw accommodating compartment 10*c* is formed so that the head 51*a* can move relative to the housing 10 in a direction parallel to the screwing axis of the male screw member 51, and the second screw accommodating compartment 10*d* is formed so that the female screw member 52 can move relative to the housing 10 in a direction parallel to the screwing axis of its own. For example, a circular cylindrical portion 12*a*, the cylindrical axis of which is concentric with the screwing axis of the male screw member 51, is formed in the covering member 12 (FIG. 9), and a space in the interior of the circular cylindrical portion 12*a* is used as the first screw accommodating compartment 10*c* (the retraction guide portion 81*b*). The circular cylindrical portion 12*a* is formed into an inner diameter slightly larger than the diameter of a hypothetical circle passing through the corners of the head 51*a*. Herein, the second screw accommodating compartment 10*d* is formed as a groove having a square cylindrical shape in the accommodation member 11 (FIG. 10 and FIG. 11). The second screw accommodating compartment 10*d* is formed, for example, as a groove having a square cylindrical shape slightly larger than the female screw member 52.

In the accommodation member 11 in this example, a third screw accommodating compartment 10*e* to accommodate a tip 51*b* of the male screw member 51 protruding through the female screw member 52 is provided, relative to which the tip 51*b* is moved in the direction parallel to the screwing axis of the male screw member 51 when the movement-enabling mechanism 82 operates (FIG. 4 and FIG. 7).

When the first electrical-connection portion 21 makes contact with the first counterpart electrical-connection portion 210A before the fixture portion 10*b* makes contact with the fixture-portion receiving portion 201*b*, the retraction mechanism 81 enables the terminal fitting 110 of the first electroconductive member 20 and the terminal of the first electric wire 101A to move in the interior of the housing 10 relative to the housing 10 with the first electrical-connection portion 21 kept in contact with the first counterpart electrical-connection portion 210A and with the sealing member 61 used as the point of support, until the fixture portion 10*b* makes contact with the fixture-portion receiving portion 201*b*. That is, during fitting of the fitting portion 10*a* into the counterpart fitting portion 201*a*, even when the first electrical-connection portion 21 makes contact with the first counterpart electrical-connection portion 210A before the fixture portion 10*b* makes contact with the fixture-portion receiving portion 201*b*, the retraction mechanism 81 enables the terminal fitting 110 of the first electroconductive member 20 and the terminal of the first electric wire 101A to retract in the interior of the housing 10. Thus, until the fixture portion 10*b* makes contact with the fixture-portion receiving portion 201*b*, the connector 1 in this embodiment can prevent excess loads from acting on the first electrical-connection portion 21 and the first counterpart electrical-connection portion 210A. Consequently, the connector 1 in this embodiment keeps preventing excess loads from acting on the first electrical-connection portion 21 and the first counterpart electrical-connection portion 210A after the completion of connection thereof to the counterpart connector and can be thus improved in durability.

When the first electrical-connection portion 21 is still out of contact with the first counterpart electrical-connection portion 210A after the fixture portion 10*b* makes contact with the fixture-portion receiving portion 201*b*, the movement-enabling mechanism 82 enables the terminal fitting 110 of the first electroconductive member 20 and the terminal of the first electric wire 101A to move relative to the housing 10 in the interior of the housing 10 with the sealing member 61 used as the point of support. Thus, during fitting of the fitting portion 10*a* into the counterpart fitting portion 201*a*, this movement-enabling mechanism 82 enables the first electrical-connection portion 21 to make contact with the first counterpart electrical-connection portion 210A even when the fixture portion 10*b* and the fixture-portion receiving portion 201*b* make contact with each other before the first electrical-connection portion 21 and the first counterpart electrical-connection portion 210A do. The connector 1 in this embodiment therefore can prevent excess loads from acting on the first electrical-connection portion 21 and the first counterpart electrical-connection portion 210A even with the first electrical-connection portion 21 and the first counterpart electrical-connection portion 210A secured by being screwed together. Consequently, the connector 1 in this embodiment can be improved in durability also in this aspect.

Furthermore, this connector 1 has the fixture portion 10*b* and the first electrical-connection portion 21 disposed offset from each other in the directions in which the fitting portion 10*a* is fit into and pulled out of the counterpart fitting portion 201*a* (FIG. 3). For this reason, a tolerance increases as an amount by which the fixture portion 10*b* and the first electrical-connection portion 21 are offset from each other (that is, the distance therebetween) increases. Such an increase results in a corresponding increase in relative positional shift of the first electrical-connection portion 21 from the first counterpart electrical-connection portion 210A along the screwing axis. However, the connector 1 in this embodiment can absorb a positional shift due to such a tolerance through the retraction mechanism 81 and the movement-enabling mechanism 82 and can be improved in durability by consequently preventing excess loads from acting on the first electrical-connection portion 21 and the first counterpart electrical-connection portion 210A.

The retraction mechanism 83 and the movement-enabling mechanism 84 in the second electroconductive member 30 are described next.

The retraction mechanism 83 is configured so that, when the first electrical-connection portion 31 makes contact with the second counterpart electrical-connection portion 210B before the fixture portion 10*b* makes contact with the fixture-portion receiving portion 201*b*, the second electroconductive member 30 and the terminal of the second electric wire 101B can be, until the fixture portion 10*b* makes contact with the fixture-portion receiving portion 201*b*, retracted in a certain direction with the first electrical-connection portion 31 kept in contact with the second counterpart electrical-connection portion 210B, the certain direction being opposite to the direction in which to fit the fitting portion 10*a*. The retraction mechanism 83 in this example includes: a protrusion 83*a* that is a part of one of the male screw member 55 and the female screw member 56 that have been screwed together, the part protruding from the second electrical-connection portion 32 and the electrical-connection portion 121; and a guide portion (hereinafter referred to as "retraction guide portion") 83*b* provided in the housing 10 and capable of guiding the protrusion 83*a* in a direction parallel to the screwing axis of these screw members (FIG. 5 and FIG. 8).

The movement-enabling mechanism 84 is configured so that, when the first electrical-connection portion 31 is still out of contact with the second counterpart electrical-connection portion 210B after the fixture portion 10*b* makes contact with the fixture-portion receiving portion 201*b*, the second electroconductive member 30 and the terminal of the second electric wire 101B can be moved relative to the housing 10 until the first electrical-connection portion 31 makes contact with the second counterpart electrical-connection portion 210B. That is, this movement-enabling mechanism 84 moves the second electroconductive member 30 and the terminal of the second electric wire 101B relative to the housing 10 in a direction opposite to the direction in which the retraction mechanism 83 does. The movement-enabling mechanism 84 in this example includes: a protrusion 84*a* that is a part of the other of the male screw member 55 and the female screw member 56 that have been screwed together, the part protruding from the second electrical-connection portion 32 and the electrical-connection portion 121; and a guide portion (hereinafter referred to as "movement-enabling guide portion") 84*b* provided in the housing 10 and capable of guiding the protrusion 84*a* in a direction parallel to the screwing axis of these screw members (FIG. 5 and FIG. 8).

Figure 8:
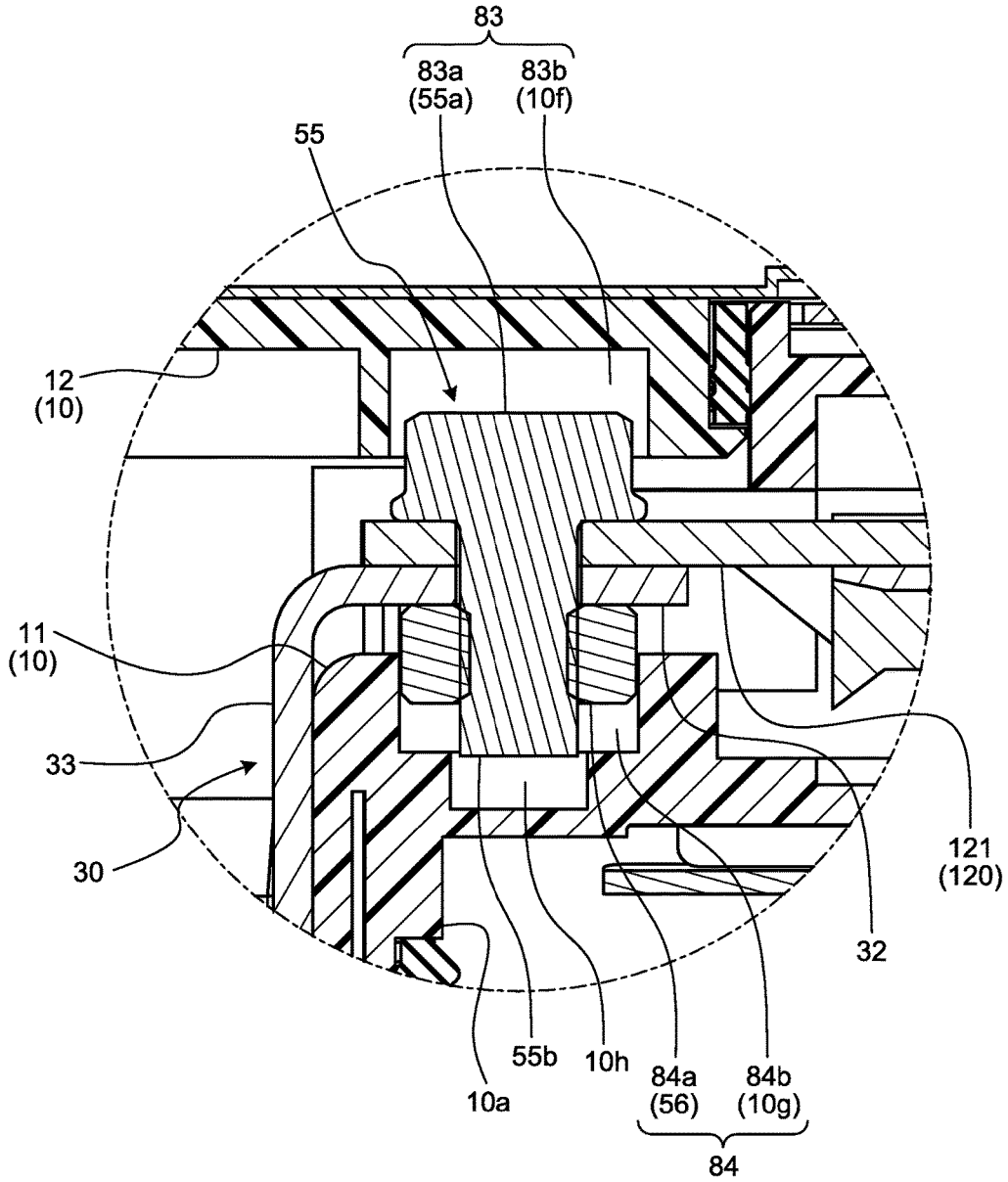
FIG. 8 is an enlarged view of the part B of FIG. 5.

The male screw member 55 and the female screw member 56 that have been screwed together are used with a polygonal (hexagonal in this example) head 55*a* of the male screw member 55 serving as the protrusion 83*a* of the retraction mechanism 83 and with the polygonal (rectangular in this example) female screw member 56 as a whole used as the protrusion 84*a* of the movement-enabling mechanism 84 (FIG. 5 and FIG. 8).

The housing 10 is provided with: a first screw accommodating compartment 10*f* to accommodate the head 55*a* of the male screw member 55; and a second screw accommodating compartment 10*g* to accommodate the female screw member 56 (FIG. 5 and FIG. 8). In this example, the first screw accommodating compartment 10*f* is used as the retraction guide portion 83*b*, and the second screw accommodating compartment 10*g* is used as the movement-enabling guide portion 84*b*. As the first screw accommodating compartment 10*f*, a compartment identical to the first screw accommodating compartment 10*c* is provided in the covering member 12 (FIG. 9). As the second screw accommodating compartment 10*g*, a compartment identical to the second screw accommodating compartment 10*d* is provided in the accommodation member 11 (FIG. 10 and FIG. 11). In the accommodation member 11 in this example, a third screw accommodating compartment 10*h* to accommodate a tip 55*b* of the male screw member 55 protruding through the female screw member 56 is provided, relative to which the tip 55*b* is moved in the direction parallel to the screwing axis of the male screw member 55 when the movement-enabling mechanism 84 operates (FIG. 5 and FIG. 8).

When the first electrical-connection portion 31 makes contact with the second counterpart electrical-connection portion 210B before the fixture portion 10*b* makes contact with the fixture-portion receiving portion 201*b*, the retraction mechanism 83 enables the terminal fitting 120 of the second electroconductive member 30 and the terminal of the second electric wire 101B to move in the interior of the housing 10 relative to the housing 10 with the first electrical-connection portion 31 kept in contact with the second counterpart electrical-connection portion 210B and with the sealing member 62 used as the point of support, until the fixture portion 10*b* makes contact with the fixture-portion receiving portion 201*b*. That is, during fitting of the fitting portion 10*a* into the counterpart fitting portion 201*a*, even when the first electrical-connection portion 31 makes contact with the second counterpart electrical-connection portion 210B before the fixture portion 10*b* makes contact with the fixture-portion receiving portion 201*b*, the retraction mechanism 83 enables the terminal fitting 120 of the second electroconductive member 30 and the terminal of the second electric wire 101B to retract in the interior of the housing 10. Thus, until the fixture portion 10*b* makes contact with the fixture-portion receiving portion 201*b*, the connector 1 in this embodiment can prevent excess loads from acting on the first electrical-connection portion 31 and the second counterpart electrical-connection portion 210B. Consequently, the connector 1 in this embodiment keeps preventing excess loads from acting on the first electrical-connection portion 31 and the second counterpart electrical-connection portion 210B after the completion of connection thereof to the counterpart connector and can be thus improved in durability.

When the first electrical-connection portion 31 is still out of contact with the second counterpart electrical-connection portion 210B after the fixture portion 10*b* makes contact with the fixture-portion receiving portion 201*b*, the movement-enabling mechanism 84 enables the terminal fitting 120 of the second electroconductive member 30 and the terminal of the second electric wire 101B to move relative to the housing 10 in the interior of the housing 10 with the sealing member 62 used as the point of support. Thus, during fitting of the fitting portion 10*a* into the counterpart fitting portion 201*a*, this movement-enabling mechanism 84 enables the first electrical-connection portion 31 to make contact with the second counterpart electrical-connection portion 210B even when the fixture portion 10*b* and the fixture-portion receiving portion 201*b* make contact with each other before the first electrical-connection portion 31 and the second counterpart electrical-connection portion 210B do. The connector 1 in this embodiment therefore can prevent excess loads from acting on the first electrical-connection portion 31 and the second counterpart electrical-connection portion 210B even with the first electrical-connection portion 31 and the second counterpart electrical-connection portion 210B secured by being screwed together. Consequently, the connector 1 in this embodiment can be improved in durability also in this aspect.

Furthermore, this connector 1 has the fixture portion 10*b* and the first electrical-connection portion 31 disposed offset from each other in the directions in which the fitting portion 10*a* is fit into and pulled out of the counterpart fitting portion 201*a* (FIG. 3). For this reason, a tolerance increases as an amount by which the fixture portion 10*b* and the first electrical-connection portion 31 are offset from each other (that is, the distance therebetween) increases. Such an increase results in a corresponding increase in relative positional shift of the first electrical-connection portion 31 from the second counterpart electrical-connection portion 210B along the screwing axis. However, the connector 1 in this embodiment can absorb a positional shift due to such a tolerance through the retraction mechanism 83 and the movement-enabling mechanism 84 and can be improved in durability by consequently preventing excess loads from acting on the first electrical-connection portion 31 and the second counterpart electrical-connection portion 210B.

In the connector 1 in this embodiment, the respective female screw members 52 and 56 are accommodated in the second screw accommodating compartments 10*d* and 10*g*, the respective second electrical-connection portions 22 and 32 are then placed on the electrical-connection portions 111 and 121, and the respective male screw members 51 and 55 are then inserted through the through-holes 22*a* and 32*a* of the second electrical-connection portions 22 and 32 and the through-holes 111*a* and 121*a* of the electrical-connection portions 111 and 121 to be screwed into the female screw members 52 and 56. For this reason, during this screwing, the rotation torque of the male screw members 51 and 55 acts on the female screw members 52 and 56, and the second screw accommodating compartments 10*d* and 10*g* each receive input corresponding to the rotation torque of the female screw members 52 and 56. The respective second screw accommodating compartments 10*d* and 10*g* may receive the input from a corner 52*b* formed between adjacent outer circumferential faces 52*a* of the female screw member 52 and a corner 56*b* formed between adjacent outer circumferential faces 56*a* of the female screw member 56. In that case, those corners 52*b* and 56*b* are forced against the respective second screw accommodating compartments 10*d* and 10*g*, thereby likely resulting in inconveniences such as impeding the operation of the retraction mechanisms 81 and 83 and the movement-enabling mechanisms 82 and 84 and deteriorating the durability thereof. For this reason, the second screw accommodating compartments 10*d* and 10*g* are preferably formed in the following shapes (FIG. 11).

The second screw accommodating compartment 10*d* has inner circumferential faces $\mathbf{10}d_1$ corresponding to the respective outer circumferential faces 52*a* of the female screw member 52 and facing and lying next to the corresponding outer circumferential faces 52*a*, and the second screw accommodating compartment 10*g* has inner circumferential faces $\mathbf{10}g_1$ corresponding to the outer circumferential faces 56*a* of the female screw member 56 and facing and lying next to the corresponding outer circumferential faces 56*a* (FIG. 11). In this example, there are four such inner circumferential faces $\mathbf{10}d_1$ corresponding to the four outer circumferential faces 52*a* and four such inner circumferential faces $\mathbf{10}g_1$ corresponding to the four outer circumferential faces 56*a*. The four inner circumferential faces $\mathbf{10}d_1$ and the four inner circumferential faces $\mathbf{10}g_1$ form the main portions of the respective shapes of the second screw accommodating compartments 10*d* and 10*g*.

These second screw accommodating compartments 10*d* and 10*g* are further provided with cutouts $\mathbf{10}d_3$ to accommodate the respective corners 52*b* of the female screw member 52 and cutouts $\mathbf{10}g_3$ to accommodate the respective corners 56*b* of the female screw member 56, the cutouts $\mathbf{10}d_3$ being formed at respective corners $\mathbf{10}d_2$ formed between adjacent ones of the inner circumferential faces $\mathbf{10}d_1$, the cutouts $\mathbf{10}g_3$ being formed at respective corners $\mathbf{10}g_2$ formed between adjacent ones of the inner circumferential faces $\mathbf{10}g_1$ (FIG. 11). Each of the cutouts $\mathbf{10}d_3$ has an arc-shaped face $\mathbf{10}d_{31}$ that connects the corresponding adjacent two inner circumferential faces $\mathbf{10}d_1$; and each of the cutouts $\mathbf{10}g_3$ has an arc-shaped face $\mathbf{10}g_{31}$ that connects the corresponding adjacent two inner circumferential faces $\mathbf{10}g_1$. These cutouts $\mathbf{10}d_3$ and $\mathbf{10}g_3$ are formed to have the arc-shaped faces $\mathbf{10}d_{31}$ and $\mathbf{10}g_{31}$ so that the corners 52*b* and 56*b* of the female screw members 52 and 56 can be prevented from being forced against the second screw accommodating compartments 10*d* and 10*g* not only when rotation torque for screwing the male screw members 51 and 55 into the female screw members 52 and 56 acts but also when rotation torque for unscrewing the male screw members 51 and 55 from the female screw members 52 and 56 acts. For example, the arc-shaped faces $\mathbf{10}d_{31}$ ($\mathbf{10}g_{31}$) are formed so as to have, at the corners $\mathbf{10}d_2$ ($\mathbf{10}g_2$) connected by each of the diagonal lines, arc-shaped wall faces symmetric about that diagonal line and located on opposite sides of that diagonal line. Thus, this connector 1 enables the retraction mechanisms 81 and 83 and the movement-enabling mechanisms 82 and 84 to smoothly operate and can prevent deterioration of its durability.

Figure 12:
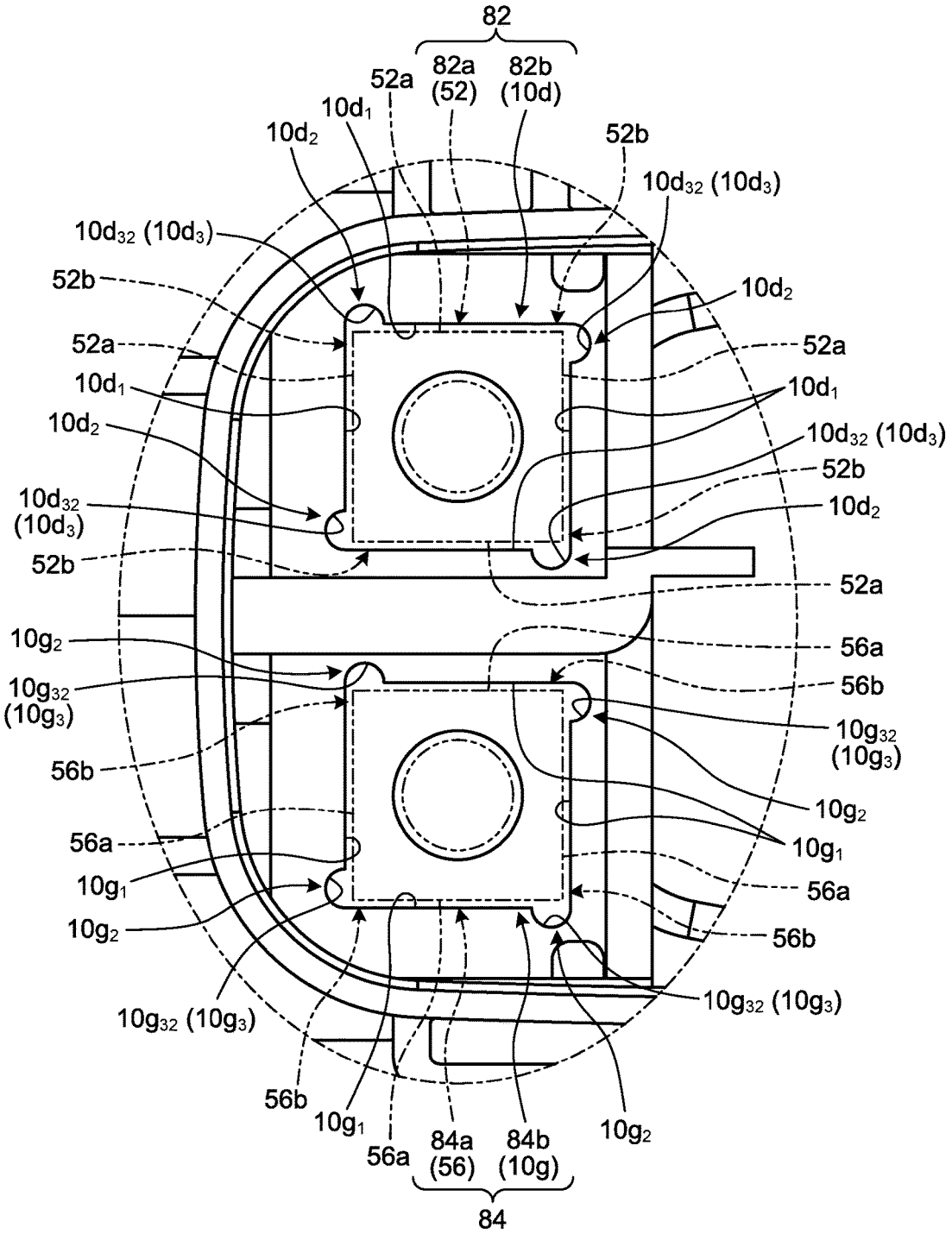
FIG. 12 is a plan view illustrating a modification of the second screw accommodating compartment of the accommodation member.

Here, as described above, the retraction mechanisms 81 and 83 and the movement-enabling mechanisms 82 and 84 are configured to operate when the fitting portion 10*a* is fit into the counterpart fitting portion 201*a*. Thus, the cutouts $\mathbf{10}d_3$ and $\mathbf{10}g_3$ consideration does not necessarily need to be formed with consideration given to rotation torque that acts in unscrewing the male screw members 51 and 55 from the female screw members 52 and 56. For this reason, the cutouts $\mathbf{10}d_3$ and $\mathbf{10}g_3$ may be formed with arc-shaped faces $\mathbf{10}d_{32}$ and $\mathbf{10}g_{32}$ as described below (FIG. 12). The arc-shaped faces $\mathbf{10}d_{32}$ ($\mathbf{10}g_{32}$) are formed so that an arc-shaped wall face of each of the corners $\mathbf{10}d_2$ ($\mathbf{10}g_2$) symmetric about and located on two opposite sides of each of the diagonal lines that connect the opposite corners $\mathbf{10}d_2$ ($\mathbf{10}g_2$) can be located on one of these sides that receives rotation torque during the screwing. In such a case also, this connector 1 enables the retraction mechanisms 81 and 83 and the movement-enabling mechanisms 82 and 84 to smoothly operate and can prevent deterioration of its durability.

Furthermore, the covering member 12 may be provided with the circular cylindrical portions 12*a* at the four respective corners thereof (FIG. 9) and be formed so that either of the spaces on the interiors of the two circular cylindrical portions 12*a* on one of the two diagonal lines of the covering member 12 can be used as the first screw accommodating compartment 10*c* (retraction guide portion 81*b*) and so that either of the spaces on the interiors of the two circular cylindrical portions 12*a* on the other diagonal line can be used as the first screw accommodating compartment 10*f* (retraction guide portion 83*b*). This enables the connector 1 to be more flexible about the orientation of the covering member 12 in attachment thereof.

A connector according to the present embodiments includes a retraction mechanism. Therefore, during fitting of a fitting portion into a counterpart fitting portion, the connector enables an electroconductive member and a terminal of an electric wire to retract in the interior of a housing even when an electrical-connection portion makes contact with a counterpart electrical-connection portion before a fixture portion makes contact with a fixture-portion receiving portion. Thus, until the fixture portion makes contact with the fixture-portion receiving portion, this connector can prevent excess loads from acting on the electrical-connection portion and the counterpart electrical-connection portion. Consequently, this connector keeps preventing excess loads from acting on the electrical-connection portion and the counterpart electrical-connection portion after the completion of connection thereof to a counterpart connector and can be thus improved in durability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a housing including a fitting portion to be fit to a counterpart fitting portion of a casing of a device to which the connector is to be connected, and a fixture portion to be secured to a fixture-portion receiving portion of the casing, the fixture portion being brought into contact with the fixture-portion receiving portion during a progress of the fitting of the fitting portion;

an electroconductive member including a first electrical-connection portion to be brought into contact with a counterpart electrical-connection portion and thereby electrically connected thereto during the progress of the fitting of the fitting portion, the counterpart electrical-connection portion being included in the counterpart fitting portion, and a second electrical-connection portion connected electrically to a terminal of an electric wire, and accommodated in an interior of the housing; and a retraction mechanism configured to, when the first electrical-connection portion makes contact with the counterpart electrical-connection portion before the fixture portion makes contact with the fixture-portion receiving portion, enable the electroconductive member and a terminal of the electric wire to be retracted, until the fixture portion makes contact with the fixture-portion receiving portion, with the first electrical-connection portion kept in contact with the counterpart electrical-connection portion.

2. The connector according to claim 1, further comprising:

a male screw member and a female screw member that are screw members together having a screwing axis set in parallel to directions in which the fitting portion is fit to and pulled out from the counterpart fitting portion, the male screw member and the female screw member being configured to fasten together an electrical-connection portion of a terminal fitting attached to a terminal of the electric wire and the second electrical-connection portion of the electroconductive member, wherein the retraction mechanism includes a protrusion that is a part of one of the male screw member and the female screw member that have been screwed together, the part protruding from the second electrical-connection portion and the electrical-connection portion, and a retraction guide portion formed in the housing and capable of guiding the protrusion in a direction parallel to the screwing axis.

3. The connector according to claim 2, wherein the fixture portion and the first electrical-connection portion are disposed offset from each other in the directions in which the fitting portion is fit into and pulled out of the counterpart fitting portion.

4. The connector according to claim 1, further comprising:

a movement-enabling mechanism configured to enable the electroconductive member and the terminal of the electric wire to move relative to the housing in a direction opposite to a direction in which the retraction mechanism does, wherein when the first electrical-connection portion is still out of contact with the counterpart electrical-connection portion after the fixture portion makes contact with the fixture-portion receiving portion, the movement-enabling mechanism enables the electroconductive member and the terminal of the electric wire to move relative to the housing until the first electrical-connection portion comes in contact with the counterpart electrical-connection portion.

5. The connector according to claim 4, further comprising:

a male screw member and a female screw member that are screw members together having a screwing axis set in parallel to directions in which the fitting portion is fit to and pulled out from the counterpart fitting portion, the male screw member and the female screw member being configured to fasten together the electrical-connection portion of the terminal fitting attached to the terminal of the electric wire and the second electrical-connection portion of the electroconductive member, wherein the retraction mechanism includes a protrusion that is a part of a first screw member that is one of the male screw member and the female screw member that have been screwed together, the part protruding from the second electrical-connection portion and the electrical-connection portion, and a retraction guide portion formed in the housing and capable of guiding the protrusion of the first screw member in a direction parallel to the screwing axis, and the movement-enabling mechanism includes a protrusion that is a part of a second screw member that is the other of the male screw member and the female screw member that have been screwed together, the part protruding from the second electrical-connection portion and the electrical-connection portion, and a movement-enabling guide portion formed in the housing and capable of guiding the protrusion of the second screw member in a direction parallel to the screwing axis.

6. The connector according to claim 5, wherein the male screw member and the female screw member that have been screwed together are used with a polygonal head of the male screw member serving as the protrusion of the retraction mechanism and with the polygonal female screw member as a whole serving as the protrusion of the movement-enabling mechanism, the housing includes a first screw accommodating compartment to accommodate the head of the male screw member, and a second screw accommodating compartment to accommodate the female screw member, the first screw accommodating compartment is formed in a manner that allows the head to move relative to the housing in a direction parallel to the screwing axis to serve as the retraction guide portion, and the second screw accommodating compartment is formed in a manner that allows the female screw member to move relative to the housing in a direction parallel to the screwing axis to serve as the movement-enabling guide portion.

7. The connector according to claim 6, wherein the second screw accommodating compartment includes cutouts at corners formed between adjacent ones of inner circumferential faces thereof facing and lying next to individual outer circumferential faces of the female screw member, the cutouts being configured to accommodate corners formed between adjacent ones of the outer circumferential faces of the female screw member, and each of the cutouts has an arc-shaped face that connects the corresponding adjacent two inner circumferential faces.

8. The connector according to claim 7, wherein the fixture portion and the first electrical-connection portion are disposed offset from each other in the directions in which the fitting portion is fit into and pulled out of the counterpart fitting portion.

9. The connector according to claim 4, wherein the fixture portion and the first electrical-connection portion are disposed offset from each other in the directions in which the fitting portion is fit into and pulled out of the counterpart fitting portion.

10. The connector according to claim 5, wherein the fixture portion and the first electrical-connection portion are disposed offset from each other in the directions in which the fitting portion is fit into and pulled out of the counterpart fitting portion.

11. The connector according to claim 6, wherein the fixture portion and the first electrical-connection portion are disposed offset from each other in the directions in which the fitting portion is fit into and pulled out of the counterpart fitting portion.

12. The connector according to claim 1, wherein the fixture portion and the first electrical-connection portion are disposed offset from each other in the directions in which the fitting portion is fit into and pulled out of the counterpart fitting portion.

* * * * *